US008749470B2

(12) United States Patent
Furihata et al.

(10) Patent No.: US 8,749,470 B2
(45) Date of Patent: Jun. 10, 2014

(54) BACKLIGHT BRIGHTNESS CONTROL FOR LIQUID CRYSTAL DISPLAY PANEL USING A FREQUENCY-DIVIDED CLOCK SIGNAL

(75) Inventors: Hirobumi Furihata, Kanagawa (JP); Takashi Nose, Kanagawa (JP)

(73) Assignee: Renesas Electronics Corporation, Kawasaki-shi, Kanagawa (JP)

( * ) Notice: Subject to any disclaimer, the term of this patent is extended or adjusted under 35 U.S.C. 154(b) by 1691 days.

(21) Appl. No.: 12/000,290

(22) Filed: Dec. 11, 2007

(65) Prior Publication Data

US 2008/0143757 A1 Jun. 19, 2008

(30) Foreign Application Priority Data

Dec. 13, 2006 (JP) ..... 2006-335383

(51) Int. Cl.
*G09G 3/36* (2006.01)
*G09G 5/02* (2006.01)

(52) U.S. Cl.
USPC ..... 345/102; 345/699

(58) Field of Classification Search
CPC . G09G 3/3406; G09G 3/3611; G09G 3/3674; G09G 3/3685; G09G 5/005; G09G 5/008
USPC ..... 345/87, 98–100, 102, 204, 213, 345/691–693, 698–699
See application file for complete search history.

(56) References Cited

U.S. PATENT DOCUMENTS 5,841,430 A * 11/1998 Kurikko ..... 345/213
5,844,540 A * 12/1998 Terasaki ..... 345/102
6,522,365 B1 * 2/2003 Levantovsky et al. ..... 348/537
6,577,322 B1 6/2003 Fukuda
6,903,716 B2 * 6/2005 Kawabe et al. ..... 345/99
7,321,400 B1 * 1/2008 Chou et al. ..... 348/616
7,348,959 B2 * 3/2008 Kim ..... 345/102
7,436,415 B2 * 10/2008 Takata et al. ..... 345/690

(Continued)

FOREIGN PATENT DOCUMENTS

JP 9-265074 A 10/1997
JP 9265074 * 10/1997 ..... F21V 8/00

(Continued)

OTHER PUBLICATIONS

Korean Office Action dated Mar. 6, 2009 with partial English-Language Translation.

(Continued)

*Primary Examiner* — Bipin Shalwala
*Assistant Examiner* — Keith Crawley
(74) *Attorney, Agent, or Firm* — McGinn IP Law Group, PLLC

(57) ABSTRACT

A display device is provided with a display panel on which a plurality of display pixels are provided; a backlight illuminating the display panel; and a display panel driver driving the display panel. The display panel driver externally receiving image data and a clock signal for controlling timings of receiving the image data. The display panel driver includes a backlight controller generating a PWM-modulated drive signal to drive the backlight. The frequency of the PWM-modulated drive signal is dependent on a frequency-divided clock signal generated by frequency dividing of the clock signal externally received. The frequency-divided clock signal is generated so that the frequency of the PWM-modulated drive signal is kept constant when the frequency of the clock signal externally received is switched.

21 Claims, 13 Drawing Sheets

(56) References Cited

U.S. PATENT DOCUMENTS

| | | | | |
|---|---|---|---|---|
| 7,570,246 | B2 * | 8/2009 | Maniam et al. | 345/102 |
| 7,834,866 | B2 * | 11/2010 | Ogawa | 345/204 |
| 7,864,155 | B2 * | 1/2011 | Kawaguchi | 345/102 |
| 8,379,149 | B2 * | 2/2013 | Jeon | 348/500 |
| 2002/0015053 | A1 * | 2/2002 | Fukuda et al. | 345/660 |
| 2004/0135798 | A1 * | 7/2004 | Someya et al. | 345/690 |
| 2005/0012702 | A1 * | 1/2005 | Kim | 345/98 |
| 2005/0083280 | A1 * | 4/2005 | Hiraki et al. | 345/87 |
| 2005/0212461 | A1 | 9/2005 | Onishi | |
| 2005/0259064 | A1 * | 11/2005 | Sugino et al. | 345/102 |
| 2006/0001641 | A1 * | 1/2006 | Degwekar et al. | 345/102 |
| 2006/0055661 | A1 * | 3/2006 | Kawaguchi | 345/102 |
| 2006/0061532 | A1 * | 3/2006 | Hashimoto | 345/89 |
| 2006/0114275 | A1 * | 6/2006 | Kim et al. | 345/698 |
| 2006/0132405 | A1 * | 6/2006 | Bai et al. | 345/88 |
| 2006/0170639 | A1 * | 8/2006 | Kawaguchi et al. | 345/98 |
| 2006/0186833 | A1 * | 8/2006 | Yu et al. | 315/307 |
| 2006/0187233 | A1 * | 8/2006 | Diefenbaugh et al. | 345/591 |
| 2006/0232541 | A1 | 10/2006 | Kudo et al. | |
| 2007/0001999 | A1 * | 1/2007 | Smith et al. | 345/102 |
| 2007/0120766 | A1 * | 5/2007 | Yanamoto | 345/38 |
| 2007/0143798 | A1 * | 6/2007 | Jira et al. | 725/62 |
| 2007/0279371 | A1 * | 12/2007 | Lee et al. | 345/102 |
| 2007/0290624 | A1 * | 12/2007 | Bai et al. | 315/209 R |

FOREIGN PATENT DOCUMENTS

| | | | | |
|---|---|---|---|---|
| JP | 2000-292767 | A | 10/2000 | |
| JP | 2000292767 | * | 10/2000 | G02F 1/133 |
| JP | 2001-142452 | A | 5/2001 | |
| JP | 2003-84738 | A | 3/2003 | |
| JP | 2005-123097 | | 5/2005 | |
| JP | 2005-274883 | A | 10/2005 | |
| JP | 2006-301166 | A | 11/2006 | |
| KR | 10-2004-0101654 | A | 12/2004 | |

OTHER PUBLICATIONS

Japanese Office Action dated Jan. 20, 2012, with partial English translation.

* cited by examiner

BACKLIGHT BRIGHTNESS CONTROL FOR LIQUID CRYSTAL DISPLAY PANEL USING A FREQUENCY-DIVIDED CLOCK SIGNAL

BACKGROUND OF THE INVENTION

1. Field of the Invention

The present invention relates to a display device, and more particularly to backlight brightness control for a display device, such as a liquid crystal display (LCD) device. This application claims the benefit of priority based on Japanese Patent Application No. 2006-335383, filed on Dec. 13, 2006, the disclosure of which is incorporated herein by reference.

2. Description of the Related Art

Liquid crystal display devices are often used in mobile information devices, such as cell phones, due to the reduced dimension. Recent requirements as to mobile information devices include not only providing function-limited substitutes for general information device, such as desktop computers, but also providing sufficient performances comparable to desktop systems.

For instance, one requirement as to the screen display of mobile information devices is to provide improved backlight brightness adjustment. Japanese Laid-Open Patent Application No. 2005-123097 discloses a backlight control technique for liquid crystal display devices.

FIG. 1 is a block diagram illustrating the configuration of a liquid crystal display device disclosed in this application. The disclosed liquid crystal display is provided with a liquid crystal display panel 41, a data line driver circuit 42, a scan line driver circuit 43, a controller 44, a lighting timing controller 45, a set of inverters $\mathbf{46}_1$ to $\mathbf{46}_4$, a set of frequency controllers $\mathbf{47}_1$ to $\mathbf{47}_4$, and a set of backlights $\mathbf{48}_1$ to $\mathbf{48}_4$ each incorporating a cold-cathode tube. Display pixels 50, each including a TFT (thin film transistor) 51 and a pixel electrode 52 opposed to a common electrode COM, are disposed on the liquid crystal display panel 41. The data line driver circuit 42 drives data lines $X_1$ to $X_m$ of the liquid crystal display panel 41, and the scan line driver circuit 43 drives scan lines $Y_1$ to $Y_m$ of the liquid crystal display panel 41.

In order to stably and efficiently turn on the cold-cathode tube backlights $\mathbf{48}_1$ to $\mathbf{48}_4$, the lighting timing controller 45 and the frequency controllers $\mathbf{47}_1$ to $\mathbf{47}_4$ provide frequency control for the drive pulse voltages $e_1$ to $e_4$ fed from the inverters $\mathbf{46}_1$ to $\mathbf{46}_4$ to the backlights $\mathbf{48}_1$ to $\mathbf{48}_4$. In this liquid crystal display device, the frequencies of the drive pulse voltages $e_1$ to $e_4$ are increased at the initial stage of lighting the backlights $\mathbf{48}_1$ to $\mathbf{48}_4$, and then decreased after the operation of the backlights $\mathbf{48}_1$ to $\mathbf{48}_4$ is stabilized.

One known method for controlling the backlight brightness is PWM (pulse width modulation) control, which involves feeding a PWM-modulated drive signal to the backlight, wherein the PWM-modulated drive signal is an ON/OFF-controlled rectangular pulse signal with the pulse width controlled in accordance with the desired brightness. This method is often applied to the backlight brightness control for an LED backlight. The backlight is turned on when the PWM-modulated drive signal is pulled up to "H", and the backlight is turned off when the PWM-modulated drive signal is pulled down to "L". The brightness of the backlight is controlled by the duty ratio of the PWM-modulated drive signal.

Conventionally, the PWM control of the backlight brightness is clocked by a dedicated clock signal. This undesirably requires feeding to an LCD driver at least two clock signals: a clock signal dedicatedly used for the PWM control and another clock signal used for data transmission of pixel data, which are data indicating the grayscale levels of the respective image pixels of frame images to be displayed; the latter is often referred to as the "dot clock". The use of two clock signals is undesirable for satisfying the requirement of the power consumption reduction; generating an increased number of clock signals undesirably increases the power consumption. The increased power consumption is one of the issues of the mobile information devices, from the background of the increased amount of data transmission for satisfying the high resolution requirement.

SUMMARY

In an aspect of the present invention, a display device is provided with: a display panel on which a plurality of display pixels are provided; a backlight illuminating the display panel; and a display panel driver driving the display panel. The display panel driver externally receives image data and a clock signal for controlling timings of receiving the image data. The display panel driver includes a backlight controller generating a PWM-modulated drive signal to drive the backlight. The frequency of the PWM-modulated drive signal is dependent on a frequency-divided clock signal generated by frequency dividing of the clock signal externally received. The frequency-divided clock signal is generated so that the frequency of the PWM-modulated drive signal is kept constant when the frequency of the clock signal externally received is switched.

BRIEF DESCRIPTION OF THE DRAWINGS

The above and other objects, advantages and features of the present invention will be more apparent from the following description of certain preferred embodiments taken in conjunction with the accompanying drawings, in which.

DESCRIPTION OF PREFERRED EMBODIMENTS

In one implementation, an LCD driver is designed to generate a clock signal used for PWM control of the backlight brightness through frequency-dividing of the dot clock signal, which is an externally-provided clock signal used for data transmission of pixel data to the LCD driver. This eliminates the need for generating a clock signal dedicated for the PWM control, effectively reducing the power consumption within the LCD device.

Figure 1:
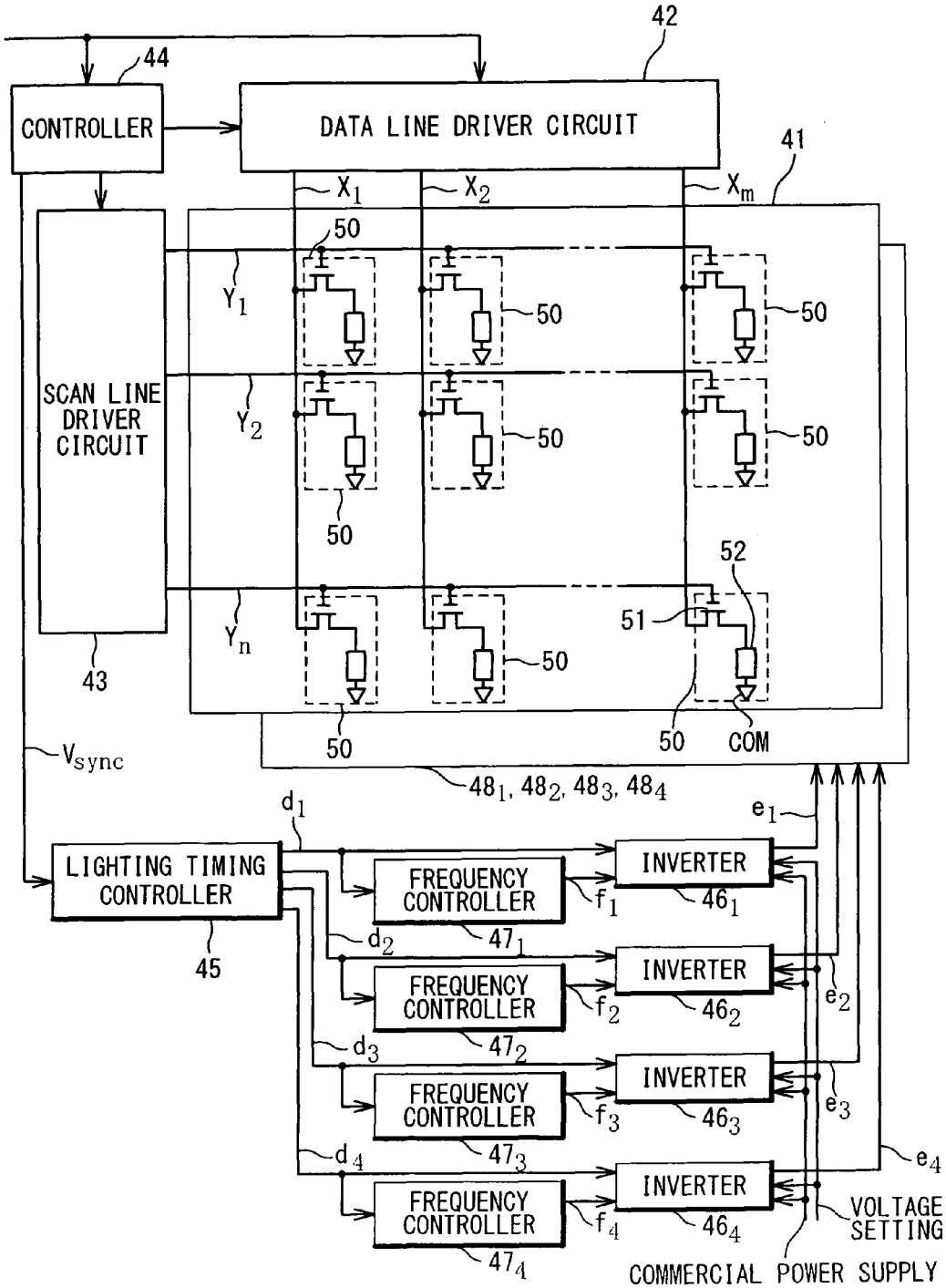
FIG. 1 is a circuit diagram illustrating the configuration of a conventional liquid crystal display device.
Figure 2:
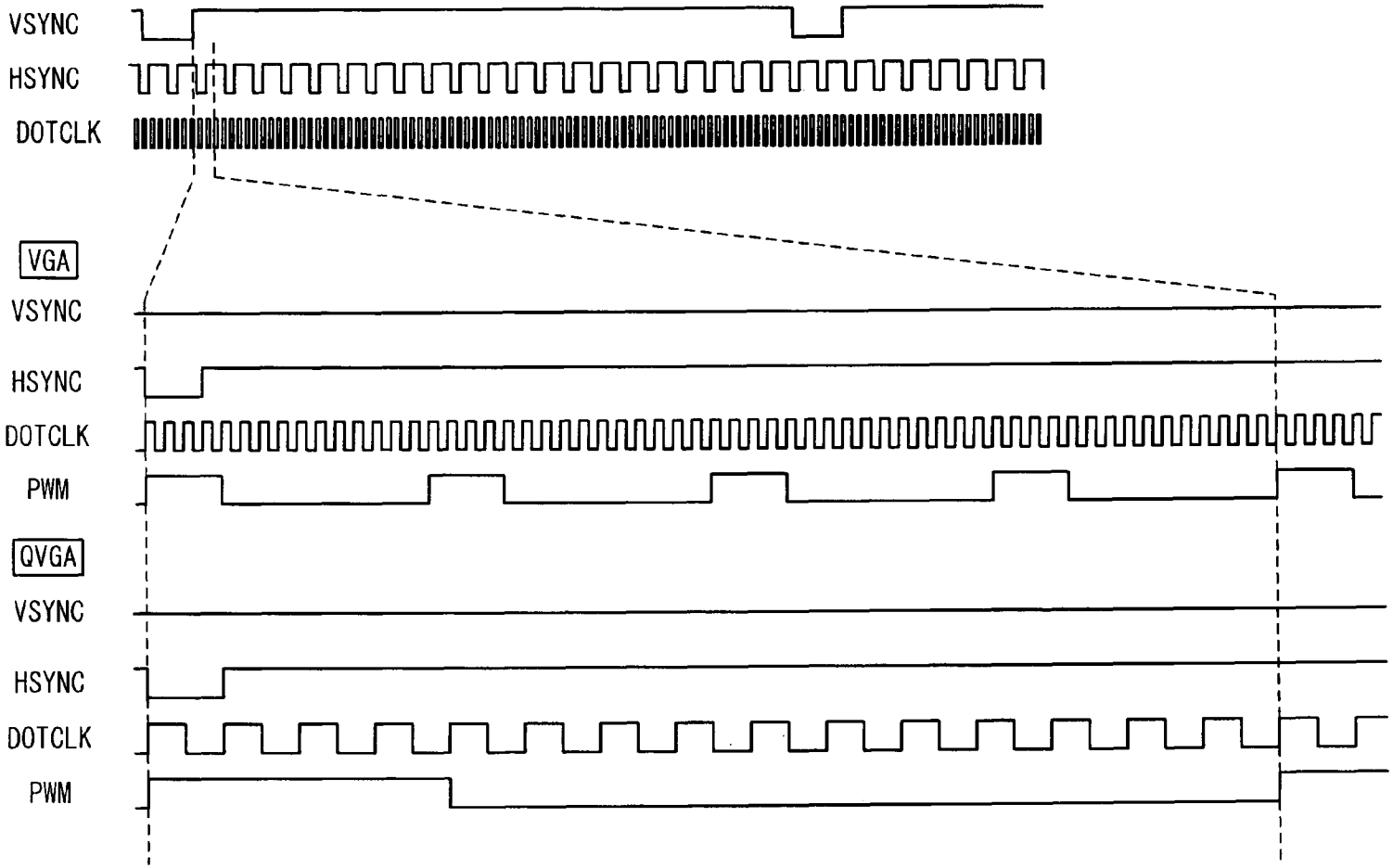
FIG. 2 is a diagram illustrating exemplary waveforms of a dot clock signal, a horizontal sync signal, and a vertical sync signal for the VGA and QVGA resolutions.

One issue of this approach is that the change in the frequency of the dot clock signal is accompanied by the change in the frequency of the clock signal used for PWM control. An LCD driver is often designed to be adapted to different image resolutions (such as the VGA (Video Graphic Array) resolution offering 640×480 image pixels, and the QVGA (quarter VGA) resolution offering 320×240 image pixels). The frequency of the dot clock signal varies depending on the image resolution as shown in FIG. 2, which illustrates typical waveforms of the dot signal DOTCLK, the horizontal sync signal Hsync, and the vertical sync signal Vsync for the VGA and QVGA resolutions.

Undesirably, the brightness of an LED backlight depends on the frequency of the PWM-modulated drive signal fed thereto, and therefore switching the frequency of the dot clock signal in accordance with the desired resolution may cause an undesirable change in the backlight brightness. The change in the brightness of an LED backlight depending on the frequency of the PWM-modulated drive signal is discussed in detail in the following.

Figure 3:
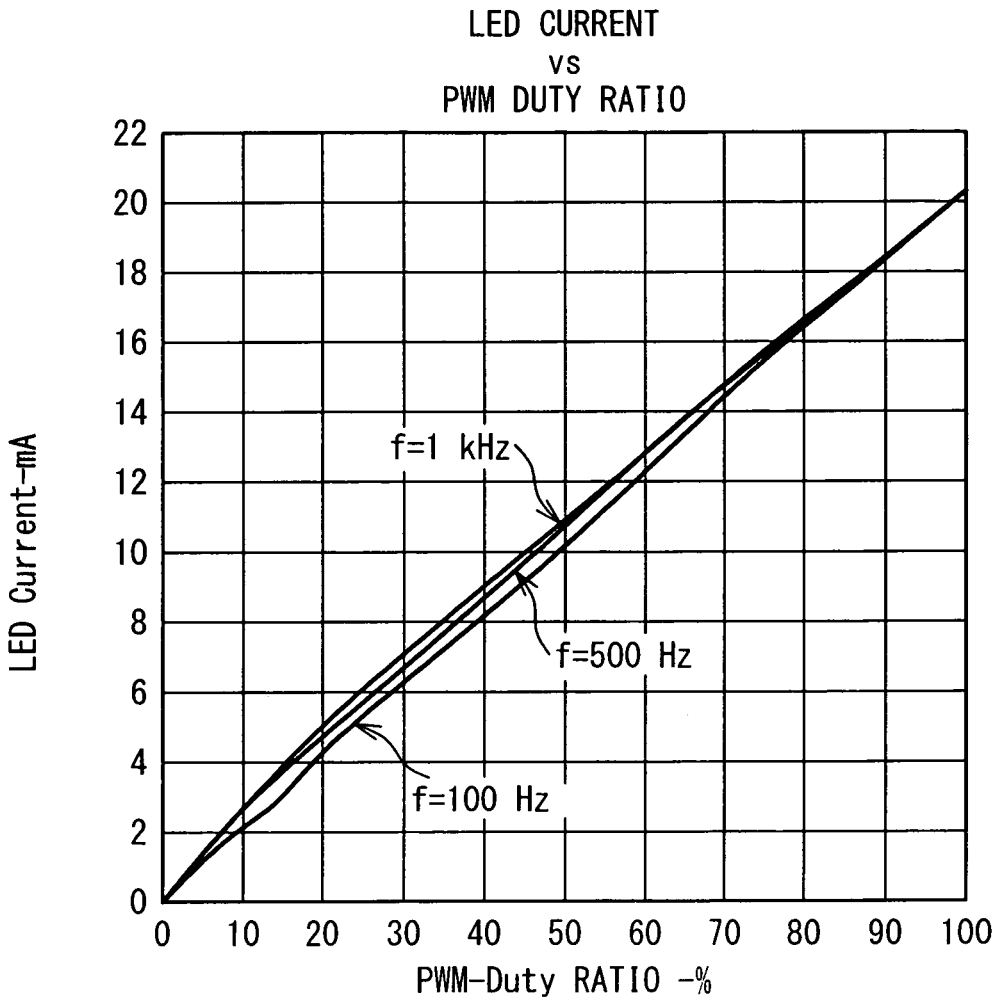
FIG. 3 is a graph illustrating the dependence of the current through an LED backlight on the PWM duty ratio.

FIG. 3 is a graph of the current through an LED backlight against the duty ratio of the PWM-modulated drive signal fed to the LED backlight. In obtaining the graph of FIG. 3, a Texas Instrument's LED driver, TPS61060 was used. The horizontal axis indicates the duty ratio of the PWM-modulated drive signal in the unit of percentage (0 to 100%) and the vertical axis indicates the current fed to the LED backlight in the unit of milliampere (0 to 22 mA). It should be noted that the current through an LED backlight is also dependent on the voltage level of the PWM-modulated drive signal, and therefore the values of the current indicated in the graph of FIG. 3 should be understood as mere examples. Three curves are shown in FIG. 3; one is for the case when the frequency of the PWM-modulated drive signal is 100 Hz, another is for 500 Hz, and the other is for 1 kHz.

The relation between the duty of the PWM-modulated drive signal and the current through the LED backlight exhibits an unignorable change against the frequency of the PWM-modulated drive signal. The brightness of the LED backlight depends on the current therethrough, therefore also depends on the frequency of the PWM-modulated drive signal. Therefore, keeping the backlight brightness constant requires remaining both of the duty and frequency of the PWM-modulated drive signal unchanged.

LCD driver architectures described in the following effectively address this issue. In the LCD driver architectures described in the following, a clock signal used for PWM control of the backlight brightness is generated through frequency-dividing of the dot clock signal. The frequency dividing ratio is controlled so that the frequency of the PWM-modulated drive signal remains unchanged even when the resolution of the image to be displayed is switched, in order to avoid an undesirable change in the backlight brightness.

In the following, the invention will be now described herein with reference to illustrative embodiments. Those skilled in the art will recognize that many alternative embodiments can be accomplished using the teachings of the present invention and that the invention is not limited to the embodiments illustrated for explanatory purposes.

(First Embodiment)

Figure 4:
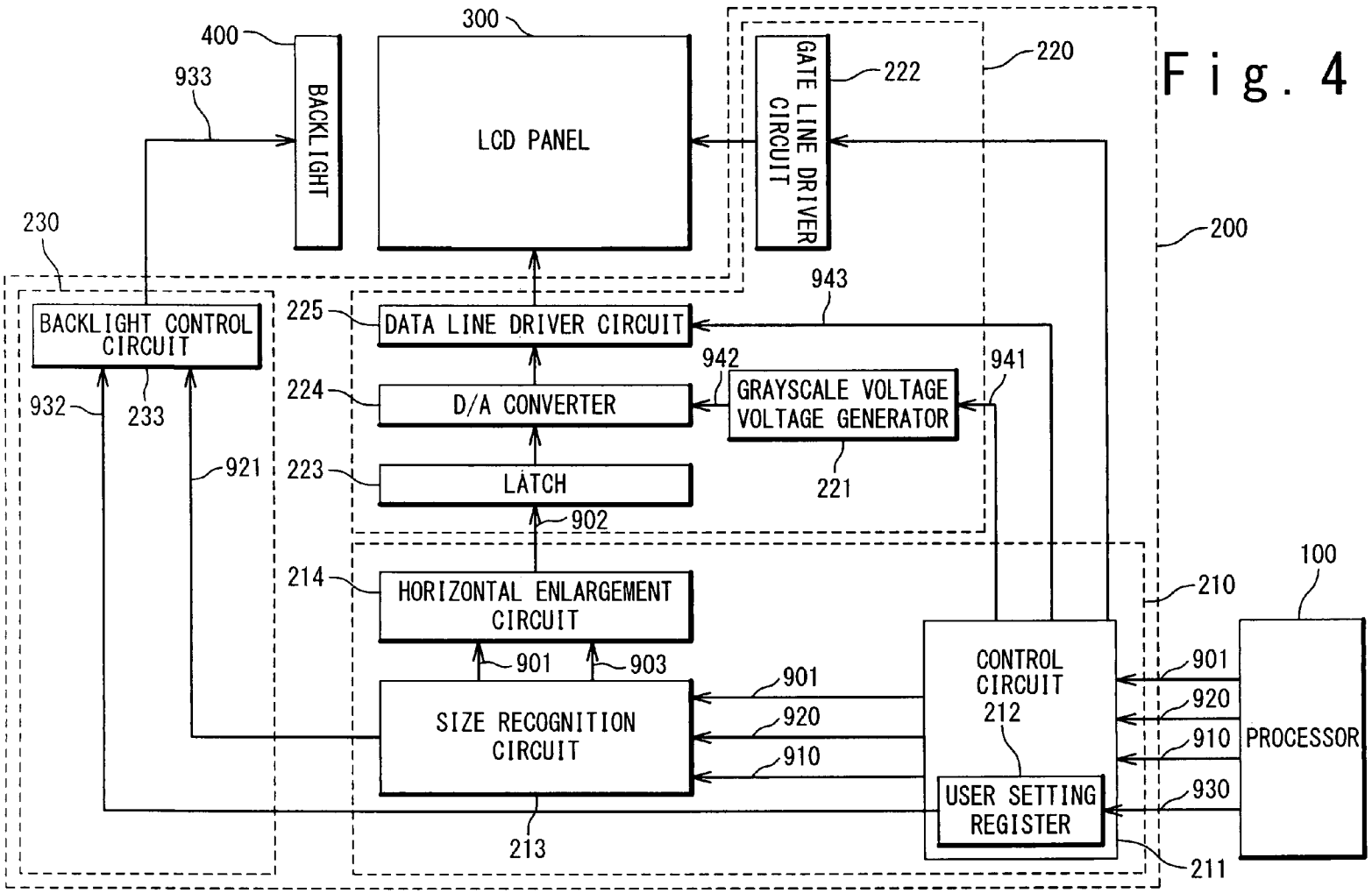
FIG. 4 is a block diagram illustrating an overall configuration of a liquid crystal display device in a first embodiment of the present invention.

FIG. 4 is a block diagram of an overall configuration of a liquid crystal display device in a first embodiment of the present invention. The liquid crystal display device in the first embodiment is provided with a processor 100, a LCD driver 200, an LCD panel 300 and a backlight 400. A plurality of display pixels are arrange in rows and columns on the LCD panel 300. In this embodiment, an LED backlight is used as the backlight 400.

The LCD driver 200 is composed of a control circuit section 210, a display panel control section 220, and a backlight control section 230. The control circuit section 210 includes a control circuit 211, a size recognition circuit 213, and a horizontal enlargement circuit 214. The control circuit 211 includes a user setting register 212. The display panel control section 220 includes a grayscale voltage generator 211, a gate line driver circuit 222, a latch circuit 223, a D/A converter 224, and a data line driver circuit 225. The backlight control section 230 includes a backlight control circuit 233.

The processor 100 is connected to the control circuit 211 and the user setting register 212. The control circuit 211 is connected to the size recognition circuit 213, the grayscale voltage generator 221, and the gate line driver circuit 222. The user setting register 212 is connected to the backlight control circuit 233. The size recognition circuit 213 is connected to the horizontal enlargement circuit 214 and the backlight control circuit 233. The horizontal enlargement circuit 214 is connected to the latch circuit 223. The latch circuit 223 is connected to the D/A converter 224. The grayscale voltage generator 221 is also connected to the D/A converter 224. The D/A converter 224 is connected to the data line driver circuit 225. The data line driver circuit 225 is connected to the LCD panel 300. The gate line driver circuit 222 is also connected to the LCD panel 300. The backlight control circuit 233 is connected to the backlight 400.

The processor 100 feeds image data 901, a dot clock signal 920, synchronization signals 910, and a user setting value 930 to the control circuit 211. The image data 901 includes pixel data indicating the grayscale levels of the corresponding image pixels in the image to be displayed. The dot clock signal 920 is a clock signal used for the synchronization in transmitting the image data 901 to the LCD driver 200; the dot clock signal 920 indicates the timings for the control circuit 211 to latch the respective pixel data of the image data 901. The synchronization signals 910 includes a horizontal sync signal Hsync and a vertical sync signal Vsync. As known in the art, the horizontal sync signal 912 is a timing signal indicating the initiation of each horizontal scan period; pixel data for one horizontal line of display pixels are transmitted to the LCD driver 200 for each horizontal scan period. On the other hand, the vertical sync signal Vsync is a timing signal indicating the initiation of each vertical scan period; pixel data for one frame image are transmitted to the LCD driver 200 for each vertical scan period. The user setting value 930 indicates desired brightness of the backlight 400 determined by the user. The user setting value 930 is stored in the user setting register 212.

The control circuit 211 transfers the received image data 901, the dot clock signal 920, and the synchronization signals 910 to the size recognition circuit 213. In addition, the control circuit 211 provides overall control of the LCD driver 200.

Specifically, the control circuit 211 generates a grayscale voltage setting signal 941, data line drive timing control signal 943, and gate line drive timing control signal 944 in response to the image data 901, the dot clock signal 920 and the synchronization signals 910, and feeds these generated signals to the grayscale voltage generator 221, the data line driver circuit 225, and the gate line driver circuit 222, respectively.

The control circuit 211 also transfers the user setting value 930 stored in the user setting register 212 to the backlight control circuit 233.

Figure 5:
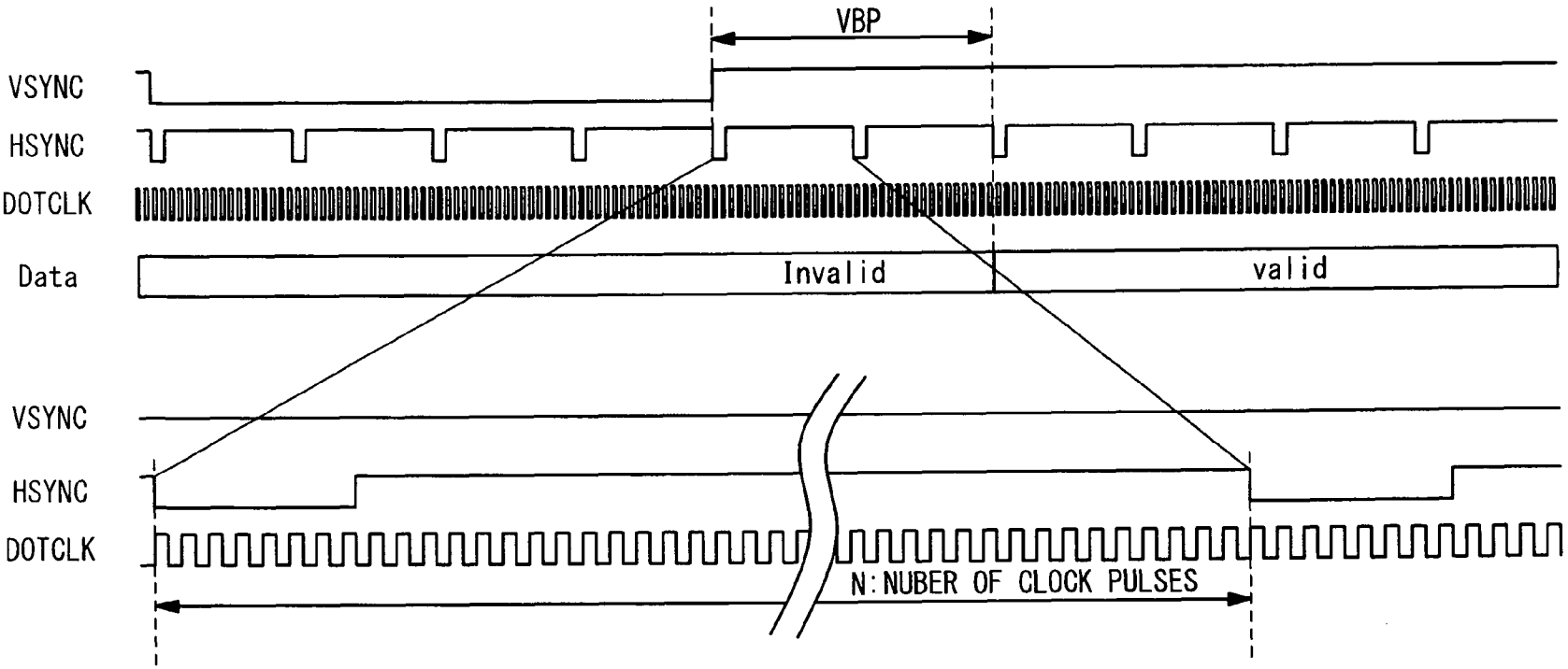
FIG. 5 is an explanatory diagram of automatic size recognition performed by the size recognition circuit.

The size recognition circuit 213 recognizes the image size (or the image resolution) defined for the image data 901, from the dot clock signal 920 and the synchronization signals 910 (including the horizontal and vertical sync signals Hsync and Vsync). FIG. 5 illustrates the dot clock signal 920 and the horizontal and vertical sync signals Hsync and Vsync. The horizontal resolution can be determined by the number of clock cycles of the dot clock signal 920 for each cycle of the horizontal sync signal Hsync (that is, each horizontal scan period). The vertical resolution can be determined by the number of cycles of the horizontal sync signal Hsync for each cycle of the vertical sync signal Vsync (that is each vertical scan period).

It should be noted, however, that when one of the horizontal and vertical resolutions is determined, the other is automatically determined for the case that the allowed image resolutions are preliminary given. When only two types of resolutions: VGA (640×480 image pixels) and QVGA (320×240 image pixels) are allowed, for example, the entire image resolution can be determined by counting the number of clock cycles of the dot clock signal 910 for a certain cycle of the horizontal sync signal Hsync; when 480 cycles (or more) of the dot clock signal 910 are counted in one cycle of the horizontal synchronizing signal Hsync, the image can be determined to be in the VGA format; otherwise, the image can be determined to be in the QVGA format.

The automatic size recognition processing is preferably performed during a vertical back porch (VBP) period. During the vertical back porch period, the LCD panel 300 is not driven by the LCD driver 200; this effectively avoids the delay in the image display due to the time period necessary for the automatic size recognition processing, and the disturbance of the display image which potentially occurs when adjacent two frame images have different resolutions.

The result of the automatic image size recognition is used for two purposes: First, the size recognition circuit 213 is responsive to the result of the automatic image size recognition for generating a frequency-divided clock signal 921, which is used for clocking in the PWM control of the backlight brightness. The frequency-divided clock signal 921 is a clock signal generated through frequency-dividing of the dot clock signal 910. The frequency of the frequency-divided clock signal 921 determines a PWM-modulated drive signal 933 fed to the backlight 400. The frequency dividing ratio of the frequency-dividing is determined depending on the image size (or the resolution) defined for the image data 901. As discussed later, the frequency dividing ratio is determined so that the frequency of the frequency-divided clock signal 921 remains unchanged against the change in the frequency of the dot clock signal 910. It should be noted that the frequency dividing ratio may be set to one; in this case, the frequency-divided clock signal 921 is generated by reproduction of the dot clock signal 910. In one implementation, the frequency dividing ratio is set to sixteen for the VGA resolution, while the frequency dividing ratio is set to four for the QVGA resolution; the frequency of the frequency-divided clock signal 921 is one-sixteenth of that of the dot clock signal 920 when the image to be displayed is in the VGA resolution, while the frequency of the frequency-divided clock signal 921 is one-fourth of that of the dot clock signal 920 when the image to be displayed is in the QVGA resolution.

Second, the size recognition circuit 213 is responsive to the result of the automatic image size recognition for generating a horizontal image enlargement control signal 903, which is fed to the horizontal enlargement circuit 214 to indicate the enlarging ratio of horizontal image enlarging implemented in the horizontal enlargement circuit 214. The size recognition circuit 213 also transfers the image data 901 to the horizontal enlargement circuit 214.

The frequency-divided clock signal 921 generated by the size recognition circuit 213 is received by the backlight control circuit 233. The backlight control circuit 233 also receives the user setting value 930 from the user setting register 212, and generates the PWM-modulated drive signal 933 in response to the frequency-divided clock signal 921 and the user setting register 212. In details, the backlight control circuit 233 generates the PWM-modulated drive signal 933 in synchronization with the frequency-divided clock signal 921 so that the frequency of the PWM-modulated drive signal 933 is identical to the frequency-divided clock signal 921. The duty ratio of the PWM-modulated drive signal 933 is controlled over the range of 0 to 100% in response to the user setting value 930. The backlight control circuit 233 feeds the PWM-modulated drive signal 933 to the backlight 400, and thereby drives the backlight 400.

The backlight 400 illuminates the LCD panel 300 in response to the PWM-modulated drive signal 933. The backlight 400 emits light onto the LCD panel 300, while the voltage level of the PWM-modulated drive signal 933 is pulled up to "H".

On the other hand, the horizontal enlargement circuit 214 receives the image data 901 and the horizontal image enlargement control signal 903 from the size recognition circuit 213, and performs horizontal image enlargement processing on the image data 901 if requested. The resultant image data are referred to as the enlarged image data 902, in the following. The enlarged image data 902 is image data generated by enlarging the image data 901 in the horizontal direction in response to the horizontal image enlargement control signal 903. When the horizontal image enlargement control signal 903 indicates two-time enlargement in the horizontal direction, the horizontal enlargement circuit 214 duplicates the pixel data of each image pixel in the image data 901 as pixel data of the corresponding two pixels adjoining horizontally in the enlarged image data 902. When the enlargement ratio is indicated to be one by the horizontal image enlargement control signal 903, the received image data 901 are output as the enlarged image data 902 without modification. When the indicated enlargement ratio is not an integer, enlargement processing may be performed for the horizontal direction through a commonly-known technique. It should be also noted that reduction of the image data 901 in the horizontal direction may be performed in the horizontal enlargement circuit 214 through a commonly-known technique, when the indicated enlargement ratio is less than 1.

The grayscale voltage generator 221 is responsive to the grayscale voltage setting signal 941 received from the control circuit 211 for generating a set of grayscale voltages 942. The generated grayscale voltages 942 are fed to the D/A converter 224.

The gate line driver circuit 222 receives the gate line drive timing control signal 944 from the control circuit 211, and sequentially drives gate lines of the LCD panel 300 in response to the gate line drive timing control signal 944.

The latch circuit 223 latches the enlarged image data 902 in units of horizontal lines of the display pixels on the LCD panel 300, and transfers the enlarged image data 902 to the D/A converter 224. In this embodiment, the gate line driver circuit 222 and the latch circuit 223 are adapted to provide vertical image enlargement for the enlarged image data 902. In one implementation, the gate line driver circuit 222 drives adjacent two scan lines while the latch circuit 223 feeds the same pixel data to the D/A converter 224. This achieves two-time image enlargement in the vertical direction.

The D/A converter 224 receives the enlarged image data 902 in units of the horizontal lines from the latch circuit 223, and also receives the grayscale voltages 942 from the grayscale voltage generator 221. The D/A converter 224 provides D/A conversion for the enlarged image data 902 by using the grayscale voltages 942 to thereby generate voltage signals which have voltage levels corresponding to the values of the enlarged image data 902. The D/A converter 224 feeds the voltage signals generated to the data line driver circuit 225.

The data line driver circuit 225 drives data lines of the LCD panel 300 in response to the voltage signals received from the D/A converter 224. The timings of driving the data lines are controlled in response to the data line drive timing control signal 943 received from the control circuit 211.

In the following, a description is given of an exemplary operation of the LCD driver 200 for the case that the image data 901 are allowed to be in accordance with any of the VGA resolution (640×480 image pixels) and the QVGA resolution (320×240 image pixels) while the LCD panel 300 is designed in accordance with the VGA resolution. As described below, the image data 901 are subjected to two-time image enlargement for both of the horizontal and vertical directions, when the format of the image data 901 is in accordance with the QVGA resolution.

As the processor 100 feeds the image data 901, the dot clock signal 910 and the synchronization signals 920 (the horizontal and vertical sync signals Hsync and Vsync) to the LCD driver 200, the size recognition circuit 213 implements the automatic size recognition through counting the number of clock cycles of the dot clock signal 910 for a specific cycle of the horizontal sync signal Hsync included in the VBP period. When counting 480 cycles (or more) of the dot clock signal 910 for the specific cycle of the horizontal synchronizing signal Hsync, the size recognition circuit 213 determines that the image data 901 are fed in the VGA format; otherwise, the size recognition circuit 213 determines that the image data 901 are fed in the QVGA format.

Figure 6:
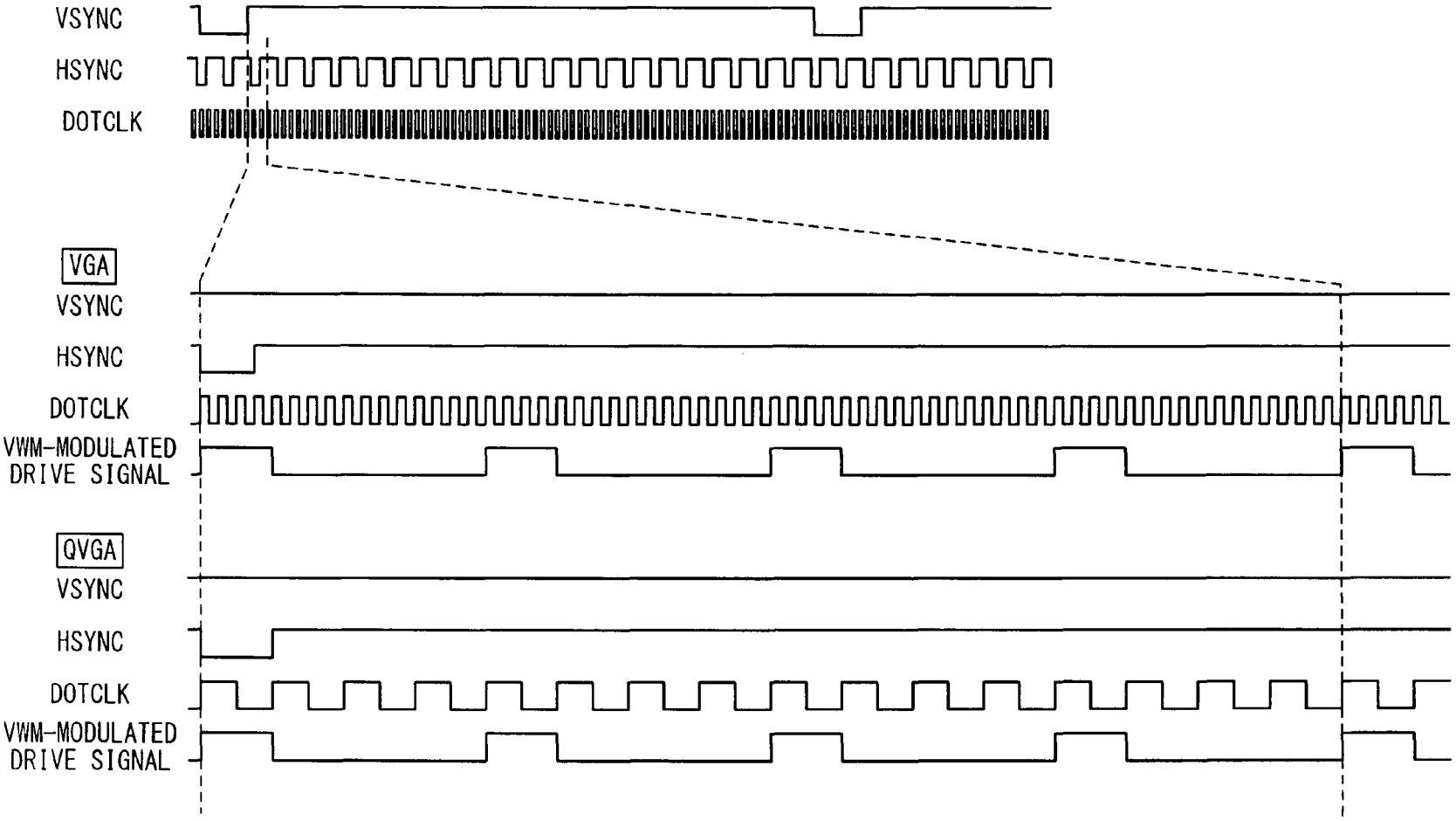
FIG. 6 is a diagram illustrating exemplary waveforms of a dot clock signal, a horizontal sync signal, a vertical sync signal, and a PWM-modulated drive signal for the VGA and QVGA resolutions in the first embodiment.

The size recognition circuit 213 generates the frequency-divided clock signal 921 through frequency-dividing of the dot clock signal DOTCLK. Although the frequency of the dot clock signal DOTCLK is different between the VGA and QVGA resolutions, the size recognition circuit 213 keeps the frequency of the frequency-divided clock signal 921 unchanged (that is, keeps the frequency of the PWM-modulated drive signal 933 unchanged) by adjusting the frequency dividing ratio, as shown in FIG. 6. In the implementation shown in FIG. 6, the size recognition circuit 213 sets the frequency dividing ratio to sixteen for the image data 901 in the VGA format, while setting the frequency dividing ratio to four for the image data 901 in the VGA format. It should be noted that, generally speaking, the size recognition circuit 213 decreases the frequency dividing ratio down to one (N×M)-th for the case the horizontal enlargement circuit 214 offers N-time horizontal image enlargement while the gate line driver circuit 222 and the latch circuit 223 offer M-time vertical image enlargement.

Figure 7:
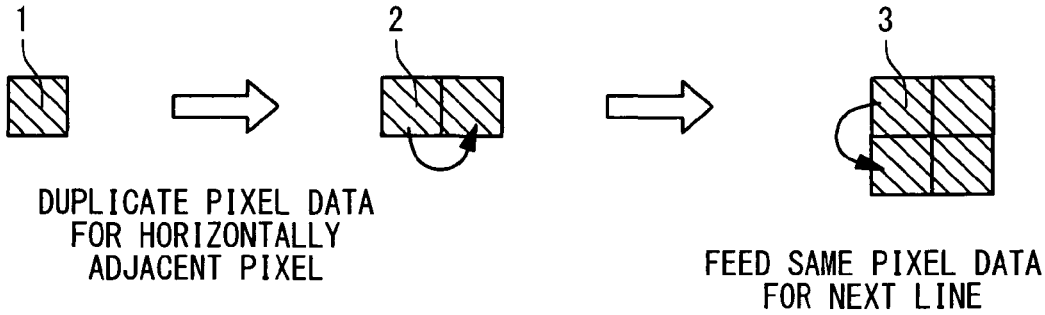
FIG. 7 is an explanatory diagram illustrating horizontal and vertical image enlargement in the first embodiment.
Figure 8A:
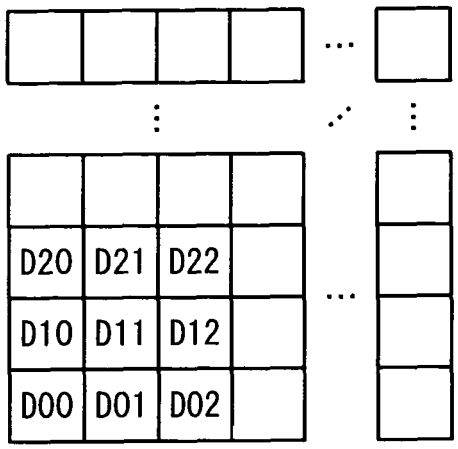
FIG. 8A is a diagram illustrating an association of pixel data with image pixels in externally provided image data.
Figure 8B:
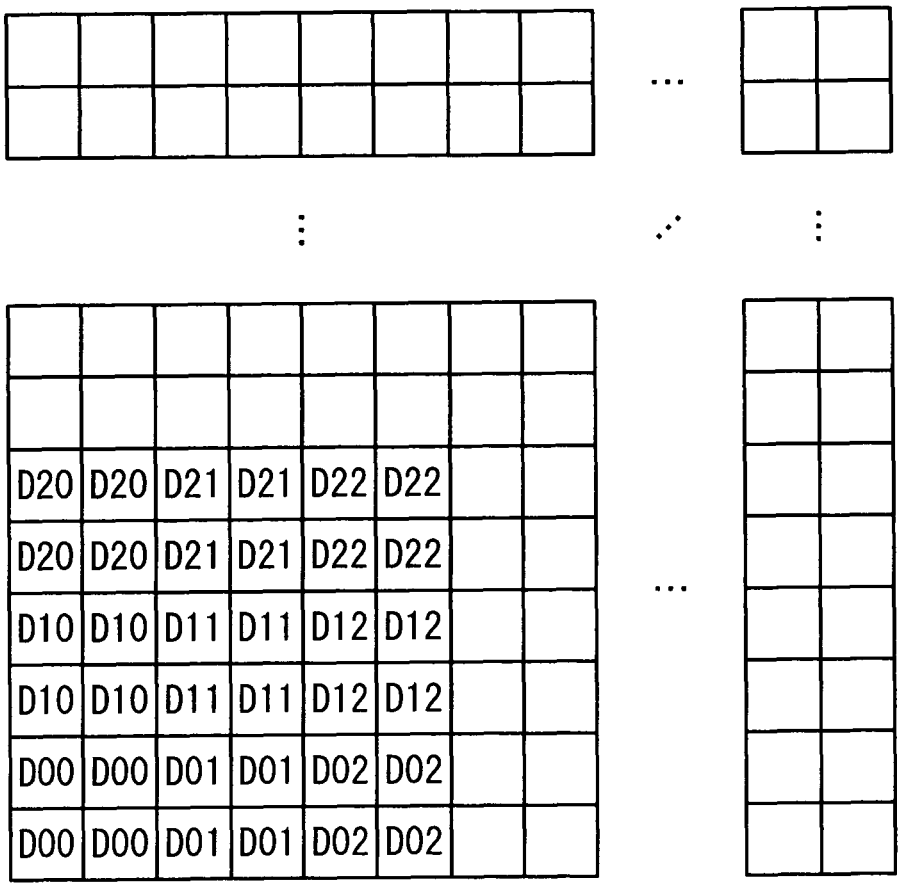
FIG. 8B is a diagram illustrating an association of pixel data with display pixels on an LCD panel externally provided image data.

FIG. 7 is a diagram illustrating the horizontal and vertical image enlargement offered by the horizontal enlargement circuit 214, the gate line driver circuit 222 and the latch circuit 223. When the image data 901 are fed in the QVGA format, the horizontal enlargement circuit 214 offers two-time horizontal image enlargement, while the gate line driver circuit 222 and the latch circuit 223 offers two-time vertical image enlargement. In detail, the horizontal enlargement circuit 214 duplicates the pixel data of each image pixel, denoted by the numeral "1", in the image data 901 as the pixel data of horizontal adjacent two pixels, denoted by the numeral "2" in the enlarged image data 902. Additionally, the gate line driver circuit 222 drives two adjacent gate lines while the latch circuit 223 feeds the same pixel data to the D/A converter 224. This results in that 2×2 pixels of the LCD panel 300, denoted by the numeral 3, are driven in response to the same pixel data. FIG. 8A and FIG. 8B illustrates an association of pixel data of the input image data 901 with the pixel data of the enlarged image data 902 used for actually driving the pixels on the LCD panel 300, in the case that two-time image enlargement are offered for both of the horizontal and vertical directions. For example, pixel data D00 associated with the bottom left image pixel in the image data 901 are used to drive an array of 2×2 pixels on the bottom-left corner of the LCD panel 300.

As thus described, the LCD driver 200 of this embodiment is designed to generate the frequency-divided clock signal 921 through the frequency dividing of the dot clock signal 910. This eliminates the need for externally feeding a clock signal dedicated for the PWM control of the backlight brightness to the LCD driver 200, effectively reducing the power consumption of the liquid crystal display device. The frequency dividing ratio is controlled on the image size (or the image resolution) defined for the image data 901 to thereby keep the frequency of the frequency-divided clock signal 921 (that is, the frequency of the PWM-modulated drive signal 933) unchanged. This effectively avoids undesirable change in the brightness of the backlight 400.

(Second Embodiment)

Figure 9:
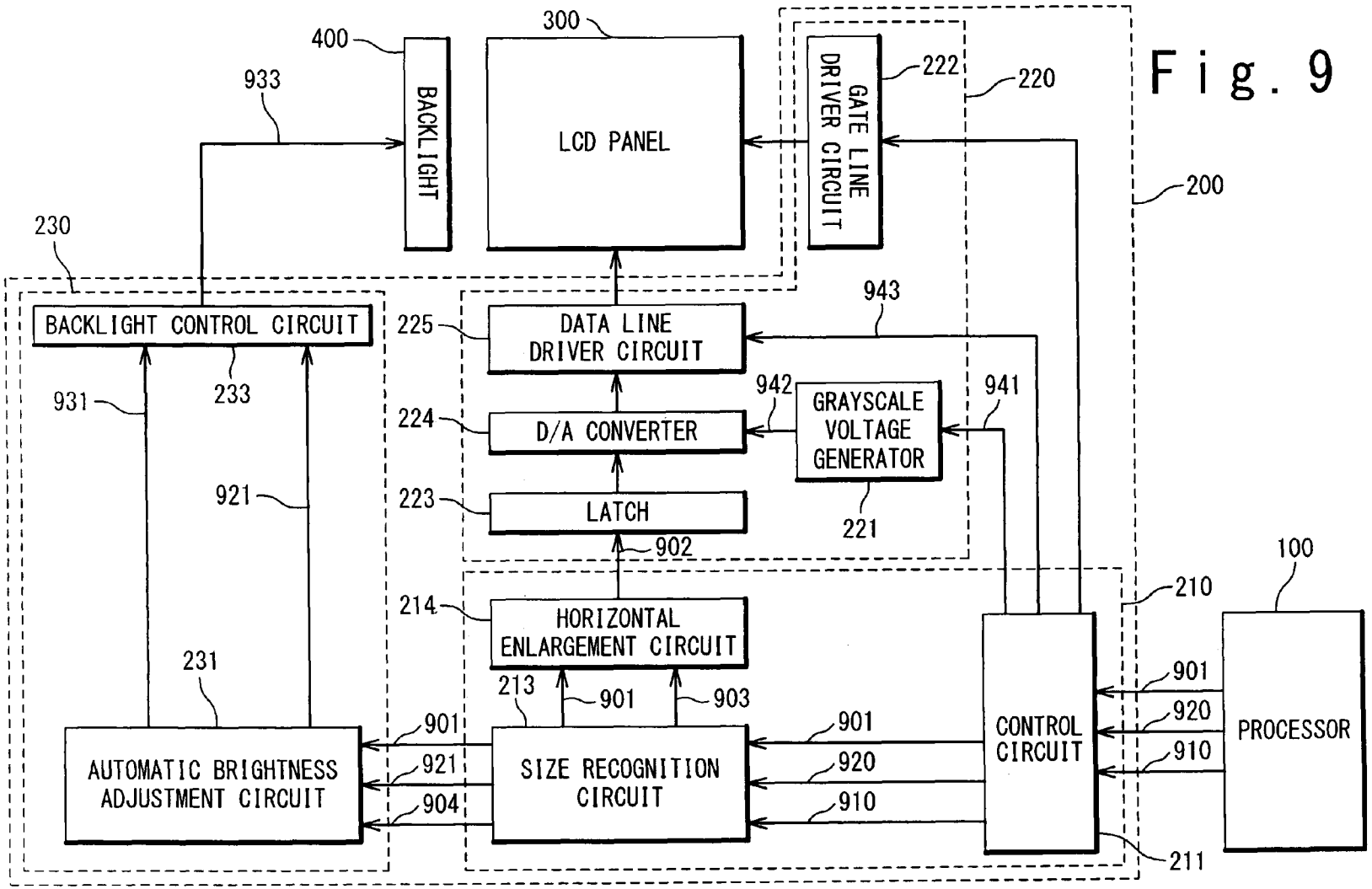
FIG. 9 is a block diagram illustrating the overall configuration of a liquid crystal display device in a second embodiment of the present invention.

FIG. 9 is a block diagram illustrating an exemplary overall configuration of a liquid crystal display device in a second embodiment. The liquid crystal display device of the second embodiment is structured almost identically to that of the first embodiment except for that the brightness of the backlight 400 is automatically adjusted in response to the average picture level (APL) of the displayed frame image. More specifically, an automatic brightness adjustment circuit 231 is additionally provided for the backlight control section 230, instead of the user setting register 212.

In the second embodiment, the size recognition circuit 213 generates an image resolution signal 904 indicating the horizontal and vertical resolutions defined for the image data 901, in addition to the image horizontal enlargement control signal 903 and the frequency-divided signal 921. As discussed in the first embodiment, the size recognition circuit 21 may determine the horizontal resolution from the number of clock cycles of the dot clock signal 910 for each horizontal scan period, and determine the vertical resolution from the number of cycles of the horizontal sync signal Hsync for each vertical scan period. The generation of the image horizontal enlargement control signal 903 and the frequency-divided signal 921 is achieved in the same manner as the first embodiment. The size recognition circuit 213 feeds the image data 901, the frequency-divided clock signal 921 and the image resolution signal 904.

The automatic brightness adjustment circuit 231 generates an automatic brightness setting value 931 in response to the image data 901, the frequency-divided clock signal 921 and the image resolution signal 904 received from the size recognition circuit 213. The automatic brightness setting value 931 indicates the desired brightness of the backlight 400. More specifically, the automatic brightness adjustment circuit 231 calculates the APL of each frame image calculated from the image data 901, and determines the automatic brightness setting value 931 from the calculated APL. The automatic brightness setting value 931 is increased as the increase in the calculated APL, so that the brightness of the backlight 400 is increased as the increase in the calculated APL.

In calculating the APL, the automatic brightness adjustment circuit 231 uses the number of the pixels included in each frame image which are indicated by the image resolution signal 904. In one implementation, the automatic brightness adjustment circuit 231 determines the automatic brightness setting value 931 from the APL by using a database table describing the correspondence between the APL and the automatic brightness setting value 931. Instead, the automatic brightness adjustment circuit 231 may incorporate a program to calculate the automatic brightness setting value 931 from the APL.

The backlight control circuit 233 receives the frequency-divided clock signal 921 and the automatic brightness setting value 931 from the automatic brightness adjustment circuit 231, and generates the PWM-modulated drive signal 933 in response to the frequency-divided clock signal 921 and the automatic brightness setting value 931. In details, the backlight control circuit 233 generates the PWM-modulated drive signal 933 in synchronization with the frequency-divided clock signal 921 so that the frequency of the PWM-modulated drive signal 933 is identical to the frequency-divided clock signal 921. The duty ratio of the PWM-modulated drive signal 933 is controlled over the range of 0 to 100% in response to the automatic brightness setting value 931. The backlight control circuit 233 feeds the PWM-modulated drive signal 933 to the backlight 400, and thereby drives the backlight 400.

The backlight 400 illuminates the LCD panel 300 in response to the PWM-modulated drive signal 933. The backlight 400 emits light onto the LCD panel 300, while the voltage level of the PWM-modulated drive signal 933 is pulled up to "H".

In the LCD driver architecture described above, the brightness of the backlight 400 is increased for a frame image with an increased APL, and is decreased for a frame image with a decreased APL. This effectively reduces the variations in the overall brightness of the LCD panel 300.

One issue in controlling the brightness of the backlight 400 on the APL is the increased amount of calculation necessary for calculating the APL. A conventional method of calculating the APL of a certain frame image involves calculating the total sum of the brightnesses of all the image pixels within the frame image (hereinafter, referred to as the total brightness sum YTotal), and dividing the total brightness sum YTotal by the total number of the image pixels. This method, however, suffers from the slow calculation speed, because of the increased calculation load necessary for the division operation compared to the addition and subtraction operations.

In this embodiment, a special technique is used to improve the calculation speed in calculating the APL, as described below.

In this embodiment, the APL is calculated as the brightness fraction F defined by the following formula:

$$F = \frac{\sum_i Y_i}{\text{Sum_Ymax}}, \tag{1}$$

where $Y_i$ is the brightness value of the pixel i, and Sum_Ymax is the summation of the allowed maximum brightness defined by:

$$\text{Sum_}Ymax = Ymax \times N_{pixel},$$

where Ymax is the allowed maximum brightness of the pixel, and $N_{pixel}$ is the total number of pixels in the target frame image. The sigma of the numerator in Formula (1) means the summation for all the pixels in the target frame image.

The brightness fraction F given by Formula (1) indicates the overall brightness of the target frame image represented in the form of the number of pixels with the allowed maximum brightness included in one frame image; when a target frame image has a brightness fraction of F, it implies that the overall brightness of the target frame image is virtually identical to the overall brightness of an image that includes F pixels with the allowed maximum brightness. When the brightness values Yi are successively accumulated for the respective pixels in the target frame image and a count value is incremented by one every when the accumulated sum reaches any multiple of the allowed maximum brightness Ymax, the brightness fraction F is obtained as the resultant count value. In this approach, the maximum value of the brightness fraction F is one, i.e., 100%. In order to facilitate the calculation, this approach is modified so that the maximum value of the brightness fraction F is 256. More specifically, the brightness fraction F is obtained by increasing the brightness fraction F by one every time the count value reaches one 256-th of the total number of pixels in the image.

Figure 10:
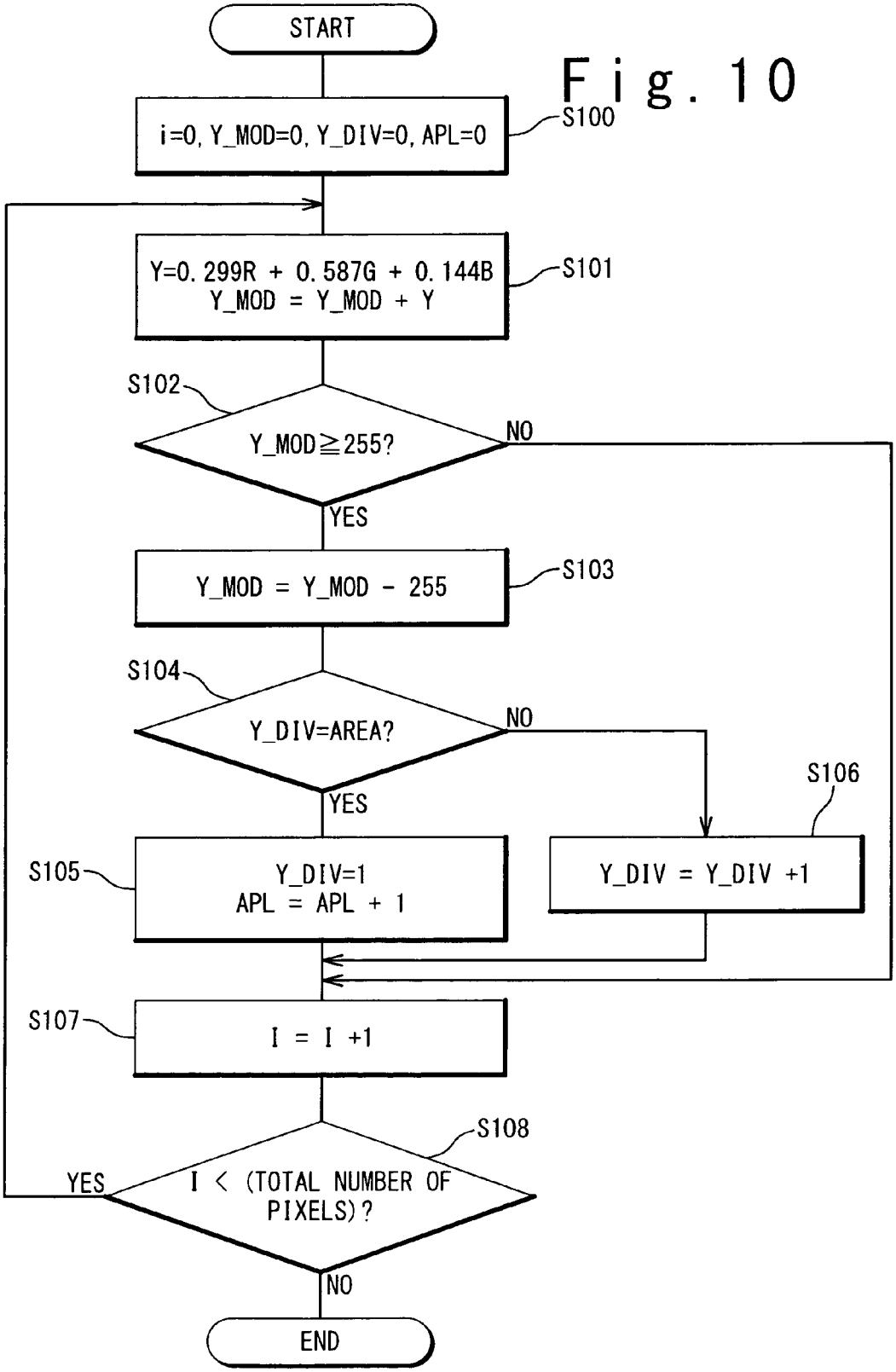
FIG. 10 is a flowchart illustrating the procedure of calculating the average picture level (APL)

In an actual implementation, the APL is preferably calculated through a procedure shown in FIG. 10. In this procedure, the quotient Y_DIV and the remainder Y_MOD when YTotal is divided by 256 are calculated only through addition and subtraction operations, instead of calculating YTotal by accumulation of the brightness values $Y_i$.

At the step S100, variables i, Y_MOD, Y_DIV, and APL are reset to zero. The variable "i" is used for identify the pixels included in the target frame image. The variable "APL" is used to calculate the average of the brightness values over the target frame image through accumulative addition. The APL of the target frame image is obtained as the value of the variable "APL" obtained at the final stage of the procedure.

At the step S101, the brightness value $Y_i$ for the target pixel i is obtained from the following formula:

$$Y_i = 0.299R_i + 0.587G_i + 0.114B_i,$$

where $R_i$, $G_i$, and $B_i$ are the grayscale levels of the red dot (or subpixel), green dot, and blue dot of the target pixel. The variable Y_MOD is increased by the brightness value $Y_i$ thus obtained.

When Y_MOD is determined to be equal to or more than a given constant, 255 at the Step S102, Y_MOD is decreased by 255 at the step S103, and the procedure proceeds to the step S104. It should be noted that 255 is the allowed maximum value of the brightness value $Y_i$. Otherwise, the procedure jumps to the step S107.

When the variable Y_DIV is determined to be increased up to a given constant AREA at the step S104, the procedure proceeds to the step S105, where the variable APL is increased by one and the variable Y_DIV is reset to one. It should be noted that the constant AREA is the value equal to 1/256 of the total number of pixels in the target frame image. If the variable Y_DIV is not increased up to the constant AREA, the procedure proceeds to the step S106.

At the step S106, the variable Y_DIV is increased by one.

At Steps S107 and S108, the variable i is increased by one and it is checked whether the at-end condition is satisfied. Accordingly, the steps S101 to 106 are looped for all the pixels in the target frame image.

Finally, the APL of the target frame image is obtained as the value stored in the variable APL.

It should be noted that the above-described procedure completely excludes the division in calculating the APL, effectively reducing the calculation amount. This effectively improves the calculation speed. It should be also noted that the calculation of the APL and the image enlargement processing are carried out in parallel in this procedure; the use of the original image data 901 (not the enlarged image data 902) for calculating the APL allows such parallel operations. This effectively enhances the overall operation speed of the LCD driver 200.

Figure 11:
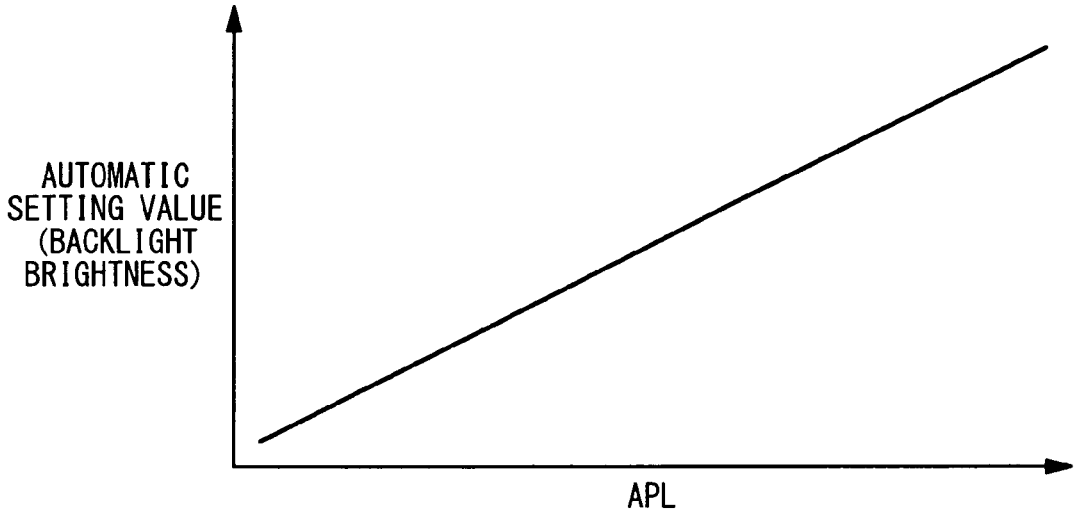
FIG. 11 is a diagram illustrating the correspondence between the APL and an automatic brightness setting value.

FIG. 11 roughly illustrates the correspondence between the APL and the automatic brightness setting value 931. The automatic brightness setting value 931 is increased as the obtained APL is increased, allowing the brightness of the backlight 400 to be increased as the entire frame image is brighter on average. On the other hand, the automatic brightness setting value 931 is decreased as the obtained APL is decreased, allowing the brightness of the backlight 400 to be decreased as the entire frame image is darker.

(Third Embodiment)

Figure 12:
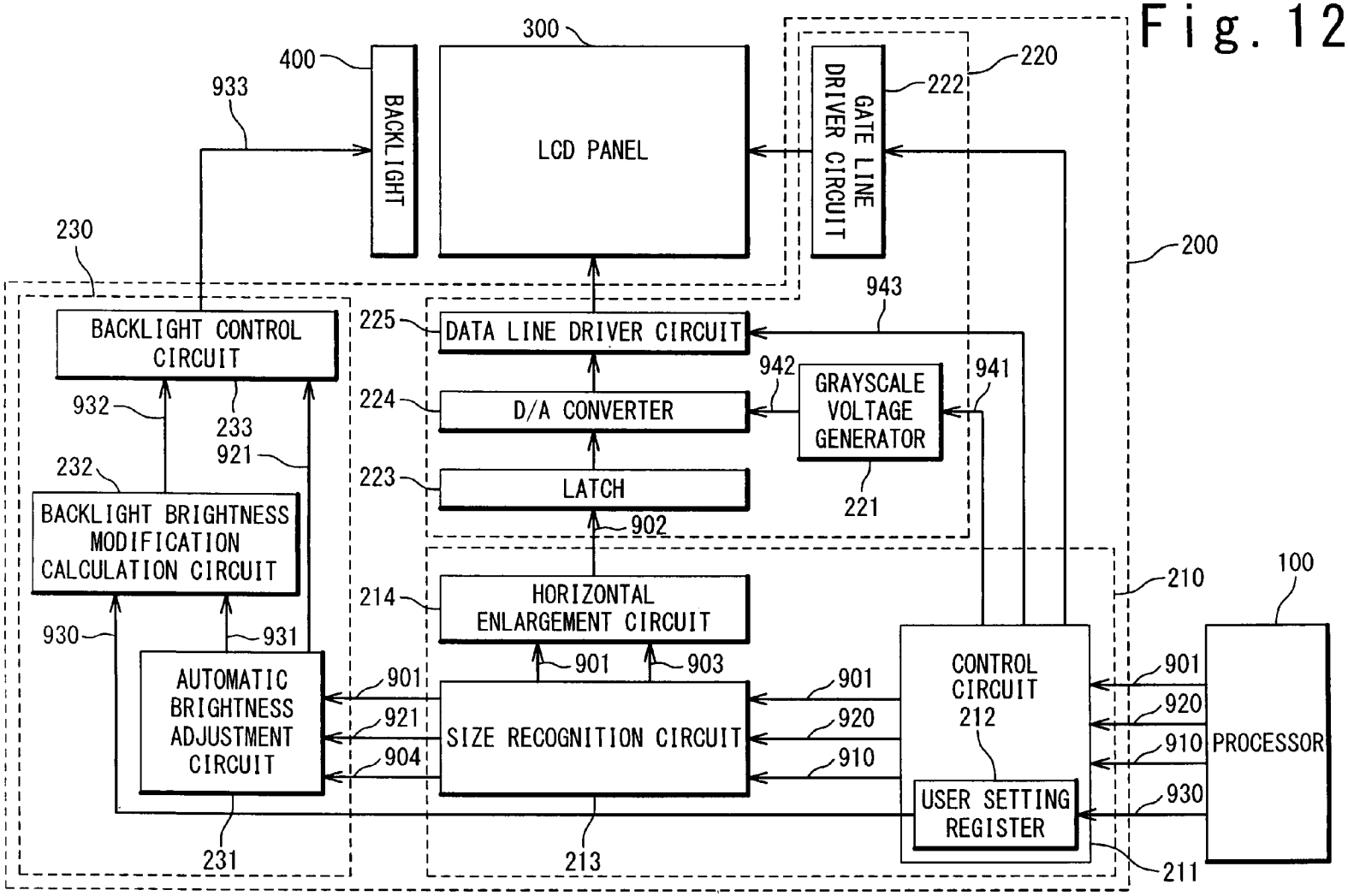
FIG. 12 is a block diagram illustrating the overall configuration of a liquid crystal display device in a third embodiment.

FIG. 12 is a block diagram illustrating an exemplary overall configuration of a liquid crystal display device in a third embodiment. The configuration of the liquid crystal display device of the third embodiment is almost similar to that of the first embodiment. The difference is that the brightness of the backlight 400 is controlled depending on both of the APL calculated by the automatic brightness adjustment circuit 231 and the user setting value 930 stored in the user setting register 212. In the following, a description is mainly given of this difference.

In the third embodiment, the backlight control section 230 additionally includes an automatic brightness adjustment circuit 231 and a backlight brightness modification calculation circuit 232. The automatic brightness adjustment circuit 231 operates almost in the same manner as described in the second embodiment; the automatic brightness adjustment circuit 231 generates the automatic brightness setting value 931 from the image data 901 and the image resolution signal 904 received from the size recognition circuit 213, while transferring the frequency-divided clock signal 921 from the size recognition circuit 213 to the backlight control circuit 233. The automatic brightness setting value 931 is fed to the backlight brightness modification calculation circuit 232 instead of the backlight control circuit 233.

The backlight brightness modification calculation circuit 232 receives the automatic brightness setting value 931 from the automatic brightness adjustment circuit 231, and receives the user setting value 930 from the user setting register 212. The backlight brightness modification calculation circuit 232 generates a resultant backlight brightness setting value 932 depending on both of the user setting value 930 and the automatic brightness setting value 931. The user setting value 930, the automatic brightness setting value 931, and the resultant backlight brightness setting value 932 are all represented in the unit of percentage, ranging from 0 to 100%. In one implementation, the resultant backlight brightness setting value 932 is simply obtained as the product of the user setting value 930 and the automatic brightness setting value 931.

The backlight control circuit 233 generates the PWM-modulated drive signal 933 in response to the frequency-divided clock signal 921 and the resultant backlight brightness setting value 932. The operation of the backlight control circuit 233 in the third embodiment is almost identical to that in the first embodiment except for that the resultant backlight brightness setting value 932 is used in place of the user setting value 930. The PWM-modulated drive signal 933 is fed to the backlight 400 to drive the backlight 400.

It is apparent that the present invention is not limited to the above embodiments, but may be modified and changed without departing from the scope of the invention. It should be especially noted that the present invention may be applied to any kind of display devices incorporating a backlight, other than liquid crystal display device.

What is claimed is:

1. A display device comprising:

a display panel on which a plurality of display pixels are provided;

a backlight illuminating said display panel; and a display panel driver driving said display panel, wherein said display panel driver externally receives image data and a clock signal for controlling timings of receiving said image data, wherein said display panel driver includesa backlight controller generating a Pulse Width Modulation (PWM)-modulated drive signal to drive said backlight, wherein said display panel driver externally receives vertical and horizontal sync signals, and said clock signal externally received by said display panel driver comprises a dot clock signal, wherein said display panel driver further includes:

a size recognition circuit which performs automatic size recognition processing to recognize a horizontal resolution of said image data in response to said dot clock signal and said vertical and horizontal sync signals in a vertical back porch period;

a horizontal enlargement circuit adapted to implement a horizontal image enlargement on said image data to generate enlarged image data in response to said recognized horizontal resolution; and a display panel control section adapted to drive said display panel in response to said enlarged image data, wherein a frequency of said PWM-modulated drive signal is dependent on a frequency-divided clock signal generated by frequency dividing of said dot clock signal externally received, and wherein said size recognition circuit generates said frequency-divided clock signal in response to said recognized horizontal resolution so that said frequency of said PWM-modulated drive signal is kept constant when a frequency of said dot clock signal externally received is switched.

2. The display device according to claim 1, wherein, when each frame image of said image data has image pixels, a number of which is less than a number of said plurality of display pixels provided on said display panel, said display panel driver implements image enlargement on said image data, and drives said display panel in response to said image data subjected to said image enlargement, while said frequency of said PWM-modulated drive signal is kept constant by controlling a frequency of said frequency-divided clock signal.

3. The display device according to claim 2, wherein said display panel driver further includes a user setting register, and wherein said backlight controller controls a duty ratio of said PWM-modulated drive signal in response to data stored in said use setting register.

4. The display device according to claim 2, wherein said display panel driver further includes an automatic brightness adjustment circuit calculating an average picture level of each frame image from said image data, and wherein said backlight controller controls a duty of said PWM-modulated drive signal in response to said calculated average picture level.

5. The display device according to claim 4, wherein, when each frame image of said image data has image pixels, a number of which is less than a number of said plurality of display pixels provided on said display panel, said automatic brightness adjustment circuit calculates said average picture level from said image data subjected to the image enlargement, and wherein said backlight controller controls a duty of said PWM-modulated drive signal in response to said calculated average picture level.

6. The display device according to claim 5, wherein a ratio of said number of image pixels of each frame to a number of the plurality of display pixels provided on the display panel comprises display pixels $1/2^n$, where n comprises an integer.

7. The display device according to claim 1, wherein said size recognition circuit recognizes a vertical resolution of said image data in said automatic size recognition processing in response to said dot clock signal and said vertical and horizontal sync signals in said vertical back porch period, wherein said display panel control section is adapted to implement a vertical image enlargement on said image data subjected to said horizontal image enlargement in response to said recognized vertical resolution, and wherein said display panel control section includes:

a grayscale voltage generator generating a set of grayscale voltages;

a latch circuit adapted to latch said enlarged image data from said horizontal enlargement circuit;

a D/A converter generating providing D/A conversion for said enlarged image data by using said grayscale voltages to thereby generate voltage signals which have voltage levels corresponding to said enlarged image data;

a data line driver circuit driving data lines of said display panel in response to said voltage signals received from said D/A converter; and a gate line driver circuit driving scan lines of said display panel in response to said recognized vertical resolution.

8. A display panel driver comprising:

a control circuit section adapted to externally receive image data, vertical and horizontal sync signals, and a dot clock signal with which a data transmission of said image data is synchronized, a display panel control section; and a backlight control section feeding a Pulse Width Modulation (PWM)-modulated drive signal to a backlight, wherein a control circuit section includes:

a size recognition circuit which performs automatic size recognition processing to recognize a horizontal resolution of said image data in response to said dot clock signal and said vertical and horizontal sync signals in a vertical back porch period; and a horizontal enlargement circuit adapted to implement horizontal image enlargement on said image data to generate enlarged image data in response to said recognized horizontal resolution, wherein a frequency of said PWM-modulated drive signal is dependent on a frequency-divided clock signal generated by frequency dividing of said dot clock signal externally received, wherein said size recognition circuit generates said frequency-divided clock signal in response to said recognized horizontal resolution so that said frequency of said PWM-modulated drive signal is kept constant when a frequency of said dot clock signal externally received is switched, and wherein said display panel control section drives a display panel in response to selected ones of said image data and said enlarged image data, so that an image displayed on said display panel is vertically enlarged in response to said recognized horizontal resolution.

9. The display panel driver according to claim 8, wherein said control circuit section includes:

a control circuit receiving said image data, said dot clock signal, and said vertical and horizontal sync signals and providing an overall control of said display panel driver;

wherein said display panel control section includes:

a grayscale voltage generator generating a set of grayscale voltages;

a latch circuit adapted to latch said selected ones of said image data and said enlarged image data from said horizontal enlargement circuit;

a D/A converter generating providing D/A conversion for said selected ones of said image data and said enlarged image data by using said grayscale voltages to thereby generate voltage signals which have voltage levels corresponding to said selected ones of said image data and said enlarged image data;

a data line driver circuit driving data lines of said display panel in response to said voltage signals received from said D/A converter; and a gate line driver circuit driving scan lines of said display panel in response to said recognized vertical resolution, and wherein said backlight control section includes a backlight control circuit generating said PWM-modulated drive signal in response to said frequency-divided clock signal.

10. The display panel driver according to claim 9, wherein said control circuit includes a user setting register storing user setting data externally received, and wherein said backlight control circuit controls a duty of said PWM-modulated drive signal in response to said user setting data.

11. The display panel driver according to claim 9, wherein said backlight control section further includes an automatic brightness adjustment circuit calculating an average picture level of each frame image from said image data, and wherein said backlight control circuit controls a duty of said PWM-modulated drive signal in response to said calculated average picture level.

12. The display panel driver according to claim 9, wherein said control circuit includes a user setting register storing user setting data externally received, wherein said backlight control section further includes:

an automatic brightness adjustment circuit calculating an average picture level of each frame image from said image data; and a backlight brightness modification calculation circuit calculating a brightness setting value from said user setting data and said average picture level, and wherein said backlight control circuit controls a duty of said PWM-modulated drive signal in response to said brightness setting value.

13. The display device according to claim 1, further comprising a user control circuit configured to latch pixel data of the image data.

14. The display device according to claim 13, wherein the clock signal indicates timings for the user control circuit to latch respective pixel data of the image data.

15. The display device according to claim 1, wherein the frequency dividing of the clock signal externally received comprises a frequency dividing ratio defined for the image data.

16. The display device according to claim 1, wherein the frequency of the frequency-divided clock signal is one-$2^n$th of the frequency of the clock signal, and wherein n comprises any integer.

17. The display device according to claim 1, wherein the frequency of the frequency divided clock signal is equal to the frequency of the PWM-modulated drive signal.

18. The display device according to claim 1, wherein the image data comprises one of image data of a QVGA format and image data of a VGA format, wherein the frequency of the clock signal externally received comprises a first frequency when the image data comprises the image data of the VGA format, and wherein the frequency of the clock signal externally received comprises a second frequency different than the first frequency when the image data comprises the image data of the QVGA format.

19. The display device according to claim 18, wherein the frequency of the PWM-modulated drive signal comprises a same frequency regardless of whether the image data comprises the QVGA format or the VGA format.

20. The display device according to claim 1, wherein the frequency-divided clock signal is generated so that a pulse width of the PWM-modulated drive signal is kept constant when the frequency of the clock signal externally received is switched.

21. The display panel driver according to claim 8, wherein the frequency-divided clock signal is generated so that a pulse width of the PWM-modulated drive signal is kept constant when the frequency of the clock signal externally received is switched.

* * * * *